US005585067A

United States Patent [19]

Leroy et al.

[11] Patent Number: 5,585,067

[45] Date of Patent: Dec. 17, 1996

[54] ALUMINUM ALLOYS CONTAINING VERY FINELY DISPERSED BISMUTH, CADMIUM, INDIUM AND/OR LEAD AND A PROCESS FOR OBTAINING THEM

[75] Inventors: Michel Leroy, St. Egreve; Marc Marticou, Foix, both of France

[73] Assignee: Aluminium Pechiney, Courbevoie, France

[21] Appl. No.: 417,680

[22] Filed: Apr. 6, 1995

[30] Foreign Application Priority Data

Apr. 11, 1994 [FR] France ..... 94 04569

[51] Int. Cl.[6] ..... C22C 21/00

[52] U.S. Cl. ..... 420/554; 148/437; 164/468; 164/499; 164/504; 266/233; 266/234; 266/235; 420/528; 420/590

[58] Field of Search ..... 420/528, 554, 420/590; 148/437; 164/468, 499, 504; 266/233, 234, 235

[56] References Cited

U.S. PATENT DOCUMENTS

| | | | |
|---|---|---|---|
| 3,715,112 | 2/1973 | Carbonnel | 266/220 |
| 3,809,379 | 5/1974 | Carbonnel et al. | 266/81 |
| 3,833,983 | 9/1974 | Baker et al. | 164/46 |
| 4,523,628 | 6/1985 | Vives | 164/468 |

FOREIGN PATENT DOCUMENTS

| | | |
|---|---|---|
| 2242477 | 6/1973 | France . |
| 1211401 | 2/1966 | Germany . |
| 1127192 | 9/1968 | United Kingdom . |

OTHER PUBLICATIONS

"Transfer and Stirring of Molten Metals Using New electromagnetic Processes", Vives, MEM. ET. SCI. REV. MET., vol. 82, Dec. 1985, pp. 643–656.

*Primary Examiner*—David A. Simmons
*Assistant Examiner*—Robert R. Koehler
*Attorney, Agent, or Firm*—Dennison, Meserole, Pollack & Scheiner

[57] ABSTRACT

An aluminum alloy containing at least one alloying metal selected from the group consisting of bismuth, cadmium, indium and lead in a quantity greater than the maximum solubility of the metal in solid aluminum. More than 80% by weight of the alloying metals are finely dispersed in a solid aluminum matrix in the form of globules or crystals with a size of less than 5 micrometers. The alloy can be obtained by means of mechanical or electromagnetic agitation of the alloy in the course of solidifying, and in the case of continuously casting a liquid alloy, the agitation can be accomplished by means of an alternating magnetic field which is coaxial to the continuous casting axis.

5 Claims, 3 Drawing Sheets

FIG.2a
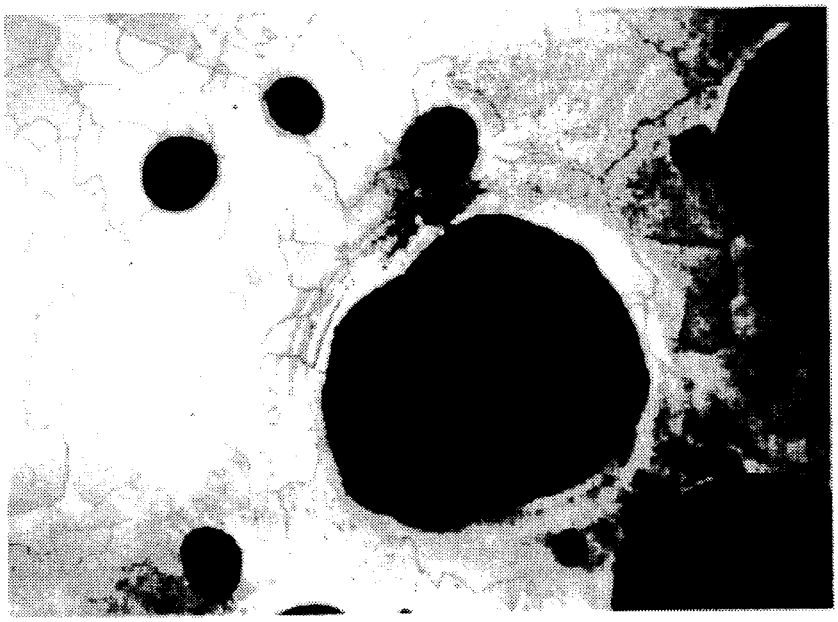
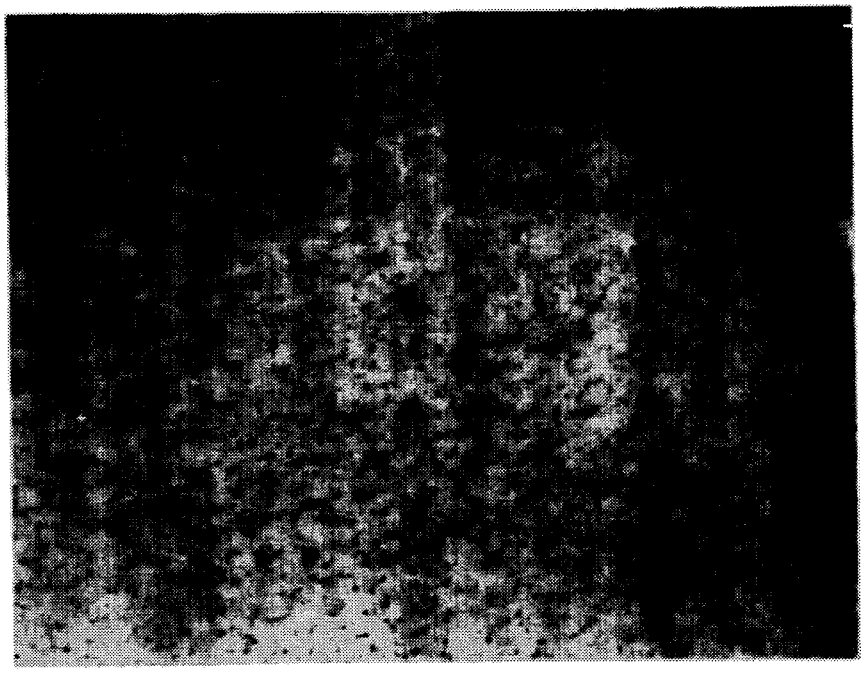
FIG.2b

ALUMINUM ALLOYS CONTAINING VERY FINELY DISPERSED BISMUTH, CADMIUM, INDIUM AND/OR LEAD AND A PROCESS FOR OBTAINING THEM

BACKGROUND OF THE INVENTION

1. Field of the Invention

The invention relates to aluminum alloys containing very finely dispersed metals which have very low solubility in solid aluminum, such as Bi, Cd, In and Pb, and to a process for solidification of such alloys.

2. Description of Related Art

For numerous years, evolution in science and technology has led to the development and marketing of increasingly higher-performance aluminum alloys. The improved performance has been achieved specifically by defining ever-narrower and more precisely targeted ranges of compositions for these alloys, which include and incorporate very small amounts of chemical elements that are also within a very narrow range of composition.

Refined aluminum intended for the manufacture of electrolytic capacitors, whose performance could be improved considerably by incorporating traces (fractions of ppm or ppm) of certain elements such as bismuth, cadmium, indium and lead, may be cited as an extreme example of this progress.

Examples of the favorable effect of dopings with traces of these metals are described in numerous documents, particularly JP 53-114059 (SHOWA AL), JP 54-043563 (SHOWA AL), JP 57-057856 (SHOWA AL), JP 57-110646 (SUMITOMO AL and TOYO), JP 63-288008 (SUMITOMO LIGHT METALS) and JP 1-128419 (SUMITOMO LIGHT METALS).

Although these patents define the desirable dopings broadly enough, they do not specify a practical way of achieving them, nor do they specify the preferred ranges of contents, which in practice would be very narrow.

The widely accepted way of carrying out such very small and very precise additions of elements favorable for the final utilization of the metal consists of the addition, fusion and dispersion of master alloys which contain these favorable elements into the liquid aluminum alloy bath to be optimized, in such quantities that the final content of favorable elements in the molten metal is within a range that is considered optimal.

However, applicants have ascertained that this widely accepted method of operation using master alloys available in the trade, even those which are very pure, led to erratic and extremely variable results which were not compatible with an optimization of the final properties required of a product produced in this way, particularly in the case of the addition of metals in the group bismuth, cadmium, indium and lead to aluminum in quantities which do not exceed 10 parts per million in the final alloy.

By examining the factors which could explain such an excessive variability of results, applicants have ascertained that its chief origin could be an insufficient homogeneity of composition of the master alloys used.

Generally, these commercially available master alloys are obtained by means of natural solidification of the molten master alloy into ingot molds in order to obtain molded pieces which are usable for the desired correction of the composition. These molded pieces most often occur in the form of molded plates with a thickness of several centimeters, which can possibly be fractionated, or cast ingots weighing several hundred grams.

But a careful examination of these products by applicants showed that heavy filler metals such as bismuth, cadmium, indium and lead which have low melting points, are not very soluble in solid aluminum and are very dense, were abnormally distributed in a very heterogeneous way, and were most often present in the form of globules or crystals with sizes larger than 20 micrometers and sometimes larger than 1 mm.

It was reasonable, then, to think that such large-size and very dense globules or crystals could remain trapped by their density at the bottom of a smelting furnace, and that the small specific surface area of large globules or crystals of filler metal thus deposited could result in very low rates of dissolution and diffusion of these dense filler metals in the less dense liquid aluminum alloy bath, thus leading to very erratic and variable final contents of these metals.

The problem to be solved, then, was to produce master alloys containing bismuth, cadmium, indium and/or lead in which these dense and not very aluminum-soluble elements would be very finely dispersed in the aluminum matrix, in a very homogeneous manner throughout the total volume.

If the phase diagrams of the binary alloys Al-Bi, Al-Cd, Al-In, and Al-Pb shown, respectively, in FIGS. 1*a*, 1*b*, 1*c*, and 1*d* are examined, it can be ascertained that these diagrams are highly similar, and that consequently Bi, Cd, In and Pb form a very specific and very homogeneous group of aluminum alloy elements.

The essential point which would largely explain the practical difficulties encountered is that the alloys of aluminum with these metals which are not very soluble in the solid state exhibit a separation phenomenon in the liquid state (the zones designated L1+L2 in the phase diagrams), implying that the usual master alloys of aluminum with these metals are inevitably diphasic and heterogenous in the solidified state, and include zones which are very rich in alloying metals, and thus very poor in aluminum. Aluminum which is poor in alloying metals would solidify first, "rejecting" a liquid which is very rich in dense alloying metals, this rich liquid having a tendency to collect in large heterogenous globules as a result of the forces of surface tension and gravity.

It therefore appeared unreasonable to attempt to obtain master alloys which included non-negligible contents of additions of "heavy" metals belonging to the group Bi, Cd, In, and/or Pb, in which these metals would be very finely dispersed in the aluminum matrix. A survey of the products available on the market confirmed this analysis.

SUMMARY OF THE INVENTION

The invention, however, proposes novel master alloys of aluminum which contain additions of heavy metals in quantities greater than the maximum solubility of these metals in aluminum which are very finely dispersed in order to have a high dissolution rate and high dissolution efficiency in liquid aluminum alloys.

More specifically, the invention relates to an aluminum alloy containing at least one metal selected from the group consisting of bismuth, cadmium, indium and lead in a quantity greater than the maximum solubility of these metals in solid aluminum, characterized in that more than 80% by weight of these alloying metals present is finely dispersed in a solid aluminum matrix in the form of globules or crystals with a size of less than 5 micrometers.

The invention also relates to a process for the solidification of such alloys which includes mechanical or electromagnetic agitation of the metal in the course of solidification, which makes it possible to produce a homogeneous mixture of aluminum crystals which are poor in alloying metals and a residual liquid which is rich in alloying metals. This mixture is capable of producing an alloy in which the alloying metals of the group Bi, Cd, In and Pb are finely dispersed in the aluminum or alloy matrix at the time of the final solidification.

BRIEF DESCRIPTION OF THE DRAWINGS

FIG. 2*a* is a photomicrograph of an alloy according to the prior art; and

FIG. 2*b* is a photomicrograph of an alloy according to the invention.

DETAILED DESCRIPTION OF THE INVENTION

Example 1

Figure 1A:
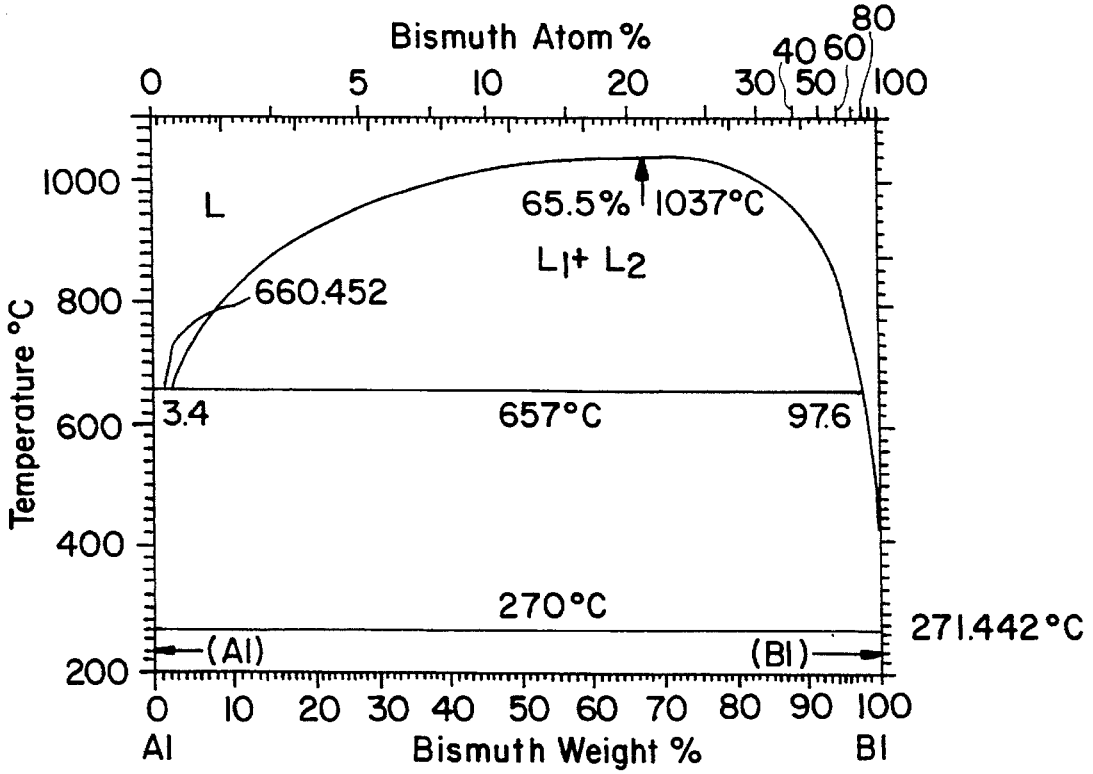
FIGS. 1*a*–1*d* are phase diagrams for binary alloys Al-Bi, Al-Cd, Al-In and Al-Pb, respectively.
Figure 1B:
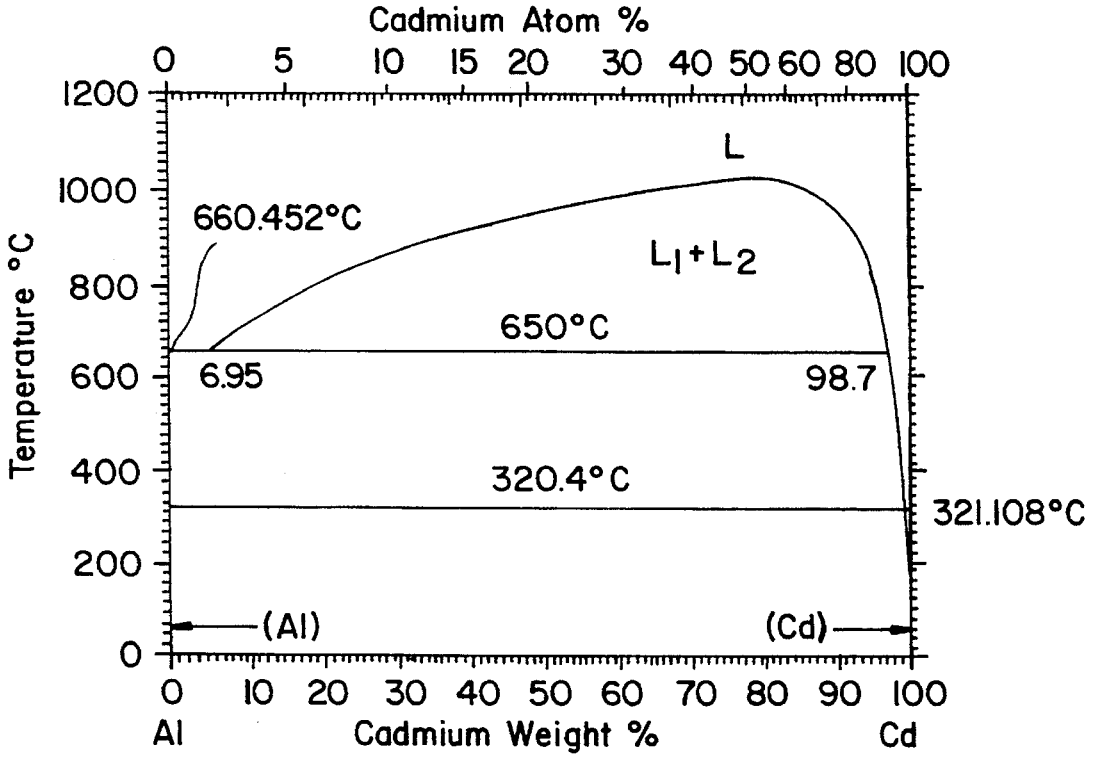
Figure 1C:
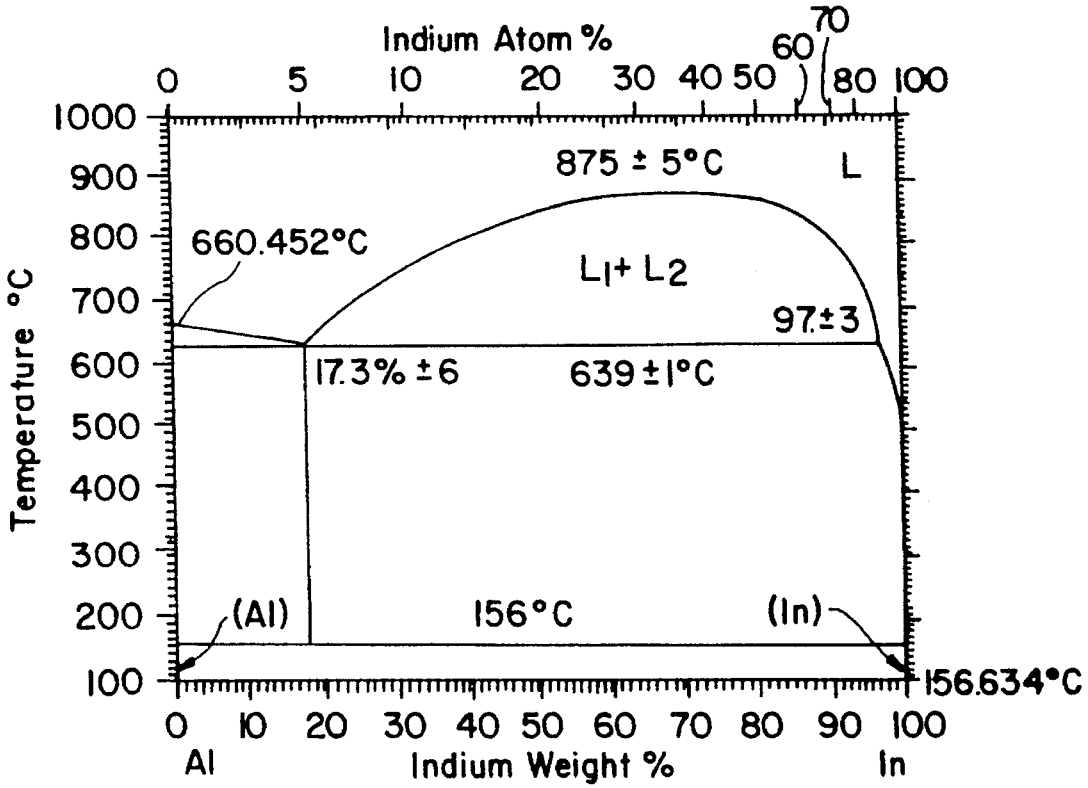
Figure 1D:
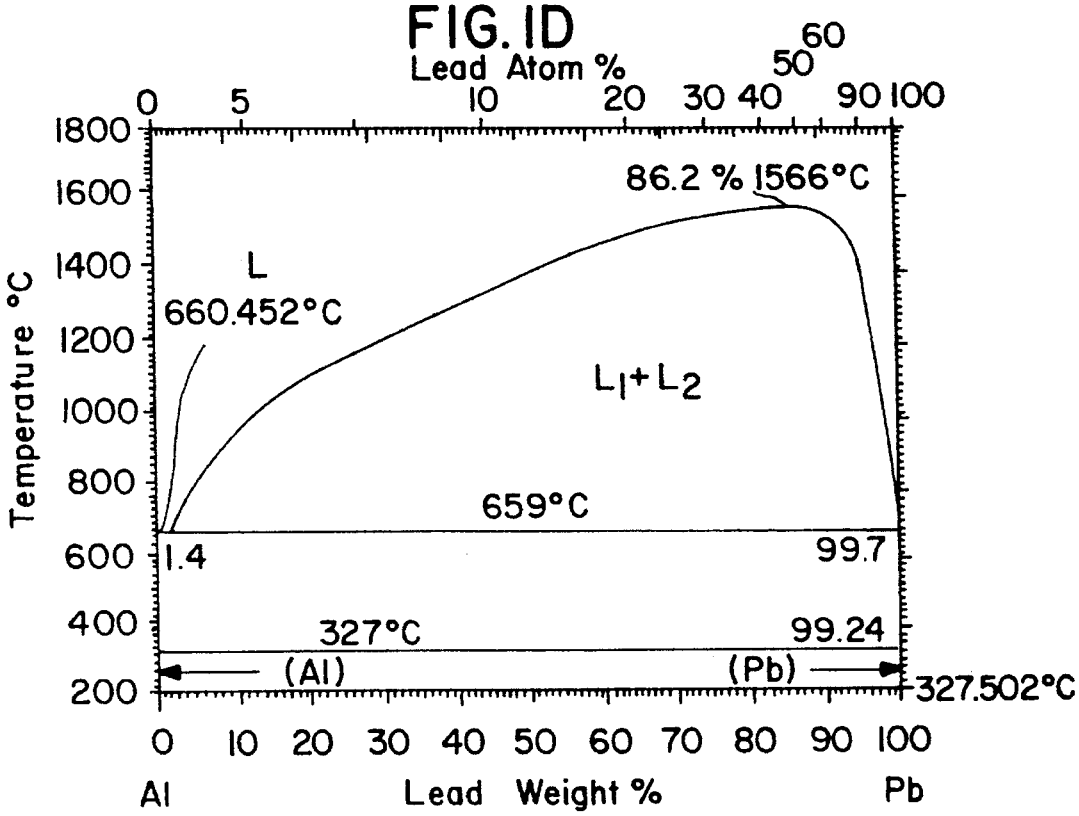

In a first experiment applicants produced, in a conventional manner, a molten aluminum alloy containing 0.20% lead, by melting 50 kg of refined aluminum and 100 g of lead in an electric furnace in a graphite crucible. The melted alloy was homogenized by agitating the liquid using a graphite rotor.

A first part of the molten alloy was cast into small ingots with a diameter of approximately 50 mm, a height of approximately 50 mm, and an individual weight of approximately 250 g, in small crucibles made of aluminum-containing refractory materials. One hundred cast ingots were produced in this way.

The rest of the molten alloy, after having been rehomogenized by the agitation of the rotor, was cast into a single billet with a diameter of 100 mm and a length of approximately 1,150 mm, in a continuous vertical casting system having a casting ring surrounded by a coil coaxial to the ring through which a low-frequency (<100 Hertz) alternating current flowed, in accordance with the French patents 2,530,510 and 2,530,511 (corresponding, respectively, to U.S. Pat. Nos. Re. 32,529 and 4,523,628, which are incorporated herein by reference). The purpose of the coil and alternating current was to cause a magneto-hydrodynamic agitation of the liquid metal during solidification, in order to maintain as much homogeneity as possible in the composition of this metal until its solidification was complete.

This billet was then cut by a band saw into sections with a thickness of approximately 15 mm. In this way, 70 sections with an average weight of approximately 320 grams per section were obtained.

The distributions of the lead in sections taken axially from 10 ingots and from 10 billets were then compared by means of macrography and micrography.

In the case of the billet sections, it was possible to establish an extremely fine dispersion of the lead in the form of small globules of a size that was mostly between 0.1 μm and 1 μm, with exceptional globules of a size greater than 5 μm but not exceeding 10 μm.

An example of the micrographs obtained after polishing and anodic oxidation of the billet sections is provided in FIG. 2*b*. It is noted that the small globules of lead are distributed in a very homogeneous manner inside the grains of aluminum, at the junction of the dendritic solidification cells having constituted these grains.

To the contrary, in the case of the ingot sections it is possible to establish, as shown in FIG. 2*a* which represents the prior art, the presence of globules with a size much greater than 20 micrometers, sometimes with segregations in the millimeter range. Moreover, the distribution of these globules is not homogeneous in the sections of the ingots.

These master alloys, in the form of ingots or billet sections, were then used to produce additions of lead into refined aluminum intended for the manufacture of electrolytic capacitors. Nine castings of approximately 12 tons combined were produced with an addition of lead in the form of master alloy ingots, and eight castings of approximately 12 tons combined were produced with an addition of lead in the form of master alloy billet sections.

The overall results obtained were as follows:

Addition of lead in the form of ingots

An evaluation of the nine castings produced the following analysis:

| | |
|---|---|
| Weight of the molten aluminum | 109,275 kg |
| Initial lead content of this aluminum | 0.193 ppm |
| Weight of the ingots loaded | 22.120 kg |
| Final lead content of the aluminum | 0.435 ppm |

Recovery efficiency of the lead supplied by the ingots: 26.38 grams effectively recovered in the cast aluminum, compared with 44.24 grams introduced by means of the ingots, for an average yield of 59%.

It is noted, moreover, that from casting to casting, the recovery efficiency of the lead introduced shows extreme variations, sometimes dropping to 30%, and sometimes rising to nearly 150%, which demonstrates that lead which is incompletely dissolved during an operation can re-emerge during a subsequent casting. Over the nine castings in question, the recovery efficiency of the lead introduced presents a standard deviation of 27%.

Addition of lead in the form of billet sections

An evaluation of the eight castings produced the following analysis:

| | |
|---|---|
| Weight of the molten aluminum | 95,530 kg |
| Initial lead content of this aluminum | 0.175 ppm |
| Weight of the sections loaded | 17.22 kg |
| Final lead content of the aluminum | 0.473 ppm |

Recovery efficiency of the lead supplied by the billet sections: 28.66 g recovered from the 34.40 g introduced by means of the sections, for an average yield of 83%.

It is noted, moreover, that there is far less divergence of the yields calculated from casting to casting; the standard deviation of the individual yields falls to 17%, most of which can be attributed to uncertainty in the analysis of the lead in such small amounts.

The comparison of Examples 1 and 2 thus shows absolutely clearly that a structure of the aluminum-lead master alloy which is more or less fine has a distinct effect on the recovery efficiency of the lead in the final product, and on the reproducibility of the results. This comparison, moreover, demonstrates that a master alloy structure such that majority (by weight) of lead is very finely dispersed in the aluminum matrix in the form of globules or crystals with a size less than 1 micrometer, leads to recovery efficiencies that are much higher and much more reproducible than a master alloy structure in which lead is mostly present in the form of globules with a size greater than 20 micrometers. The master alloy according to the invention thus has a very distinct advantage over the master alloys of the prior art.

A particular mode of obtaining such a master alloy with more than 80% by weight of the lead finely dispersed in the form of globules or crystals with a size less than 5 μm, and with more than 50% by weight of the lead finely dispersed in the form of globules or crystals with a size less than 1 μm, has been described, which comprises electromagnetic agitation of the liquid in the course of solidifying during continuous vertical casting of the metal.

Example 2

A second experiment was carried out in order to investigate whether other equivalent methods of agitation of the liquid in the process of solidifying could produce equivalent dispersion results, not only for lead, but also for the other metals of the group bismuth, cadmium and indium, which are also dense and not very soluble in solid aluminum.

In a first step, molten alloys containing, respectively, 0.15% by weight of lead, 0.50% by weight of bismuth, 1% by weight of cadmium, and 1% by weight of indium, were produced. These contents are all greater than the maximum solubility of the respective metals in solid aluminum but less than the monotectic content beyond which an immiscibility gap occurs in the liquid phase before any onset of solidification.

In each case, the liquid alloys were homogenized, in a furnace in a crucible, using a graphite rotor, then cast under the following conditions:

1) a first batch was continuously cast into a cylindrical billet, with electromagnetic agitation by an induction coil which is coaxial to the casting axis;
2) a second batch was solidified in small aluminum-containing refractory molds, without agitation;
3) a third batch was continuously cast into a cylindrical billet, with agitation of the liquid metal in the course of solidification by a graphite helix with a diameter equal to 0.5 times the diameter of the billet and a rotary speed of 250 rpm; and
4) a fourth batch was solidified in aluminum-containing refractory molds placed inside an induction coil through which an alternating current of 60 Hertz flowed, effecting electromagnetic agitation of the metal in the course of solidification.

Micrographic examination of the aluminum alloys containing additions of bismuth, cadmium, indium, and lead produced the following results:

(a) In every case, the billets cast continuously with agitation of the metal in the course of solidification produced the finest dispersion of the filler metal whether the agitation process used was electromagnetic (first batch) or mechanical (third batch). More than 80% by weight of the filler metal was dispersed in the aluminum matrix in the form of globules or crystals with a size less than 2 micrometers for lead, 3 micrometers for bismuth, and 5 micrometers for cadmium and indium.

(b) In every case, the ingots solidified in aluminum-containing refractory molds without agitation (second batch) had the least desirable dispersion, along with the frequent presence of strong segregations of the filler metals of a size greater than 100 micrometers and sometimes even greater than 1 mm.

(c) The ingots solidified in aluminum-containing refractory molds (fourth batch) with electromagnetic agitation of the metal in the course of solidification, had characteristics which fell between those in case (a) and case (b), with an average size of the globules or crystals of filler metal which was considerably smaller than the size observed in case (b), but with the occasional presence of segregations with a size greater than 100 micrometers. While offering a distinct improvement over the ingots solidified without agitation of the liquid, the ingots formed in this way did not have a structure that was as entirely fine and even as that of the continuously cast billets solidified with mechanical or electromagnetic agitation of the liquid metal.

What is claimed is:

1. An aluminum alloy containing at least one alloying metal selected from the group consisting of bismuth, cadmium, indium and lead in a quantity greater than the maximum solubility of said at least one metal in solid aluminum, more than 80% by weight of said at least one metal being finely dispersed in a solid aluminum matrix in the form of globules or crystals having a size less than 5 micrometers.

2. The aluminum alloy of claim 1, wherein said at least one alloying metal is lead, and more than 50% by weight of the lead is finely dispersed in the solid aluminum matrix in the form of globules or crystals with a size of less than 1 micrometer.

3. A process for producing an aluminum alloy comprising the steps of:

a) introducing into liquid aluminum or a liquid aluminum alloy at least one alloying element selected from the group consisting of bismuth, cadmium, indium and lead in an amount greater than the maximum solubility of said at least one metal in solid aluminum; and b) continuously casting and solidifying said liquid aluminum with said at least one alloying element, while agitating electromagnetically during said solidifying, to produce a solidified alloy in which more than 80% by weight of said at least one alloying metal is in the form of globules or crystals of a size less than 5 micrometers.

4. The process of claim 3, wherein said agitating is accomplished by disposing an induction coil coaxial with said solidifying liquid metal, and passing an alternating electric current through the coil.

5. The process of claim 3, additionally comprising adding at least a portion of said solidified alloy to a batch of liquid aluminum or aluminum alloy.

* * * * *